US010578119B2

(12) United States Patent
Lee

(10) Patent No.: US 10,578,119 B2
(45) Date of Patent: Mar. 3, 2020

(54) NECKLACE-TYPE FAN

(71) Applicant: NOVEL INNOVATIONS INC., Seoul (KR)

(72) Inventor: Jun Hyung Lee, Seoul (KR)

(73) Assignee: NOVEL INNOVATIONS INC., Seoul (KR)

( * ) Notice: Subject to any disclaimer, the term of this patent is extended or adjusted under 35 U.S.C. 154(b) by 41 days.

(21) Appl. No.: 15/542,657

(22) PCT Filed: Jan. 12, 2015

(86) PCT No.: PCT/KR2015/000298
§ 371 (c)(1),
(2) Date: Jul. 11, 2017

(87) PCT Pub. No.: WO2016/114412
PCT Pub. Date: Jul. 21, 2016

(65) Prior Publication Data
US 2017/0370596 A1 Dec. 28, 2017

(51) Int. Cl.
*F04D 29/28* (2006.01)
*F04D 25/08* (2006.01)
(Continued)

(52) U.S. Cl.
CPC ..... *F04D 29/281* (2013.01); *A41D 13/0025* (2013.01); *A41D 20/005* (2013.01);
(Continued)

(58) Field of Classification Search
CPC .... F04D 25/084; F04D 29/281; F04D 29/604; F04D 29/601; A41D 13/0025;
(Continued)

(56) References Cited

U.S. PATENT DOCUMENTS 5,146,765 A * 9/1992 Waters ..... A61F 7/02 454/370
5,304,035 A * 4/1994 Carter ..... F04D 25/084 224/258
(Continued)

FOREIGN PATENT DOCUMENTS

CN 202048007 U 11/2011
JP 55-44036 A 3/1980
(Continued)

OTHER PUBLICATIONS

International Search Report for PCT/KR2015/000298 dated Sep. 17, 2015 from Korean Intellectual Property Office.

*Primary Examiner* — Peter J Bertheaud
(74) *Attorney, Agent, or Firm* — Revolution IP, PLLC

(57) ABSTRACT

A necklace-type fan includes: a necklace part which has a curved tube shape, and has a plurality of wind blowing holes formed in a longitudinal direction of the necklace part; a wind generation part which has an interior being in communication with the necklace part, and has a fan installed to pump the wind into the necklace part; and a control unit which adjusts a rotational speed of the fan, wherein the wind introduced through the wind generation part is discharged through the wind blowing holes while being changed in intensity by the control unit.

12 Claims, 6 Drawing Sheets

(51) Int. Cl.

| | |
|---|---|
| ***A41D 13/002*** | (2006.01) |
| ***A42B 3/28*** | (2006.01) |
| ***A41D 20/00*** | (2006.01) |
| ***F24F 1/04*** | (2011.01) |
| ***F04D 29/00*** | (2006.01) |
| ***F04D 29/60*** | (2006.01) |
| *F04D 29/70* | (2006.01) |
| *F04D 17/16* | (2006.01) |
| *F04D 25/06* | (2006.01) |

(52) U.S. Cl.
CPC ..... *A42B 3/286* (2013.01); *F04D 25/084* (2013.01); *F04D 29/601* (2013.01); *F24F 1/04* (2013.01); *F04D 17/16* (2013.01); *F04D 25/0673* (2013.01); *F04D 29/005* (2013.01); *F04D 29/703* (2013.01); *F24F 2221/38* (2013.01)

(58) Field of Classification Search
CPC ..... A41D 20/005; A42B 3/286; F24F 1/04; F24F 2221/38
See application file for complete search history.

(56) References Cited

U.S. PATENT DOCUMENTS 5,802,865 A * 9/1998 Strauss ..... A41D 13/0025 62/259.3
6,125,636 A * 10/2000 Taylor ..... A61F 7/10 62/259.3
6,135,714 A * 10/2000 Hsu ..... F04D 29/601 416/146 R
6,155,782 A * 12/2000 Hsu ..... F04D 25/084 415/126
6,179,564 B1 * 1/2001 Park ..... F04D 25/084 416/146 R
6,189,327 B1 * 2/2001 Strauss ..... A41D 13/0025 62/259.3
6,464,468 B2 * 10/2002 Colburn ..... F04D 25/084 417/234
6,666,647 B1 * 12/2003 Trask ..... F04D 25/08 224/258
7,828,524 B2 * 11/2010 Chen ..... F04D 25/084 415/206
2011/0259028 A1 10/2011 Lee

FOREIGN PATENT DOCUMENTS

| | | | |
|---|---|---|---|
| JP | 11-182487 | A | 7/1999 |
| JP | 3143742 | U | 7/2008 |
| JP | 2008-286014 | A | 11/2008 |
| JP | 2013-036411 | A | 2/2013 |
| JP | 2014-236945 | A | 12/2014 |
| KR | 10-1996-0010258 | B1 | 7/1996 |
| KR | 20-2013-001357 | U | 2/2013 |
| KR | 10-1446609 | B1 | 10/2014 |

* cited by examiner

[Fig. 1]
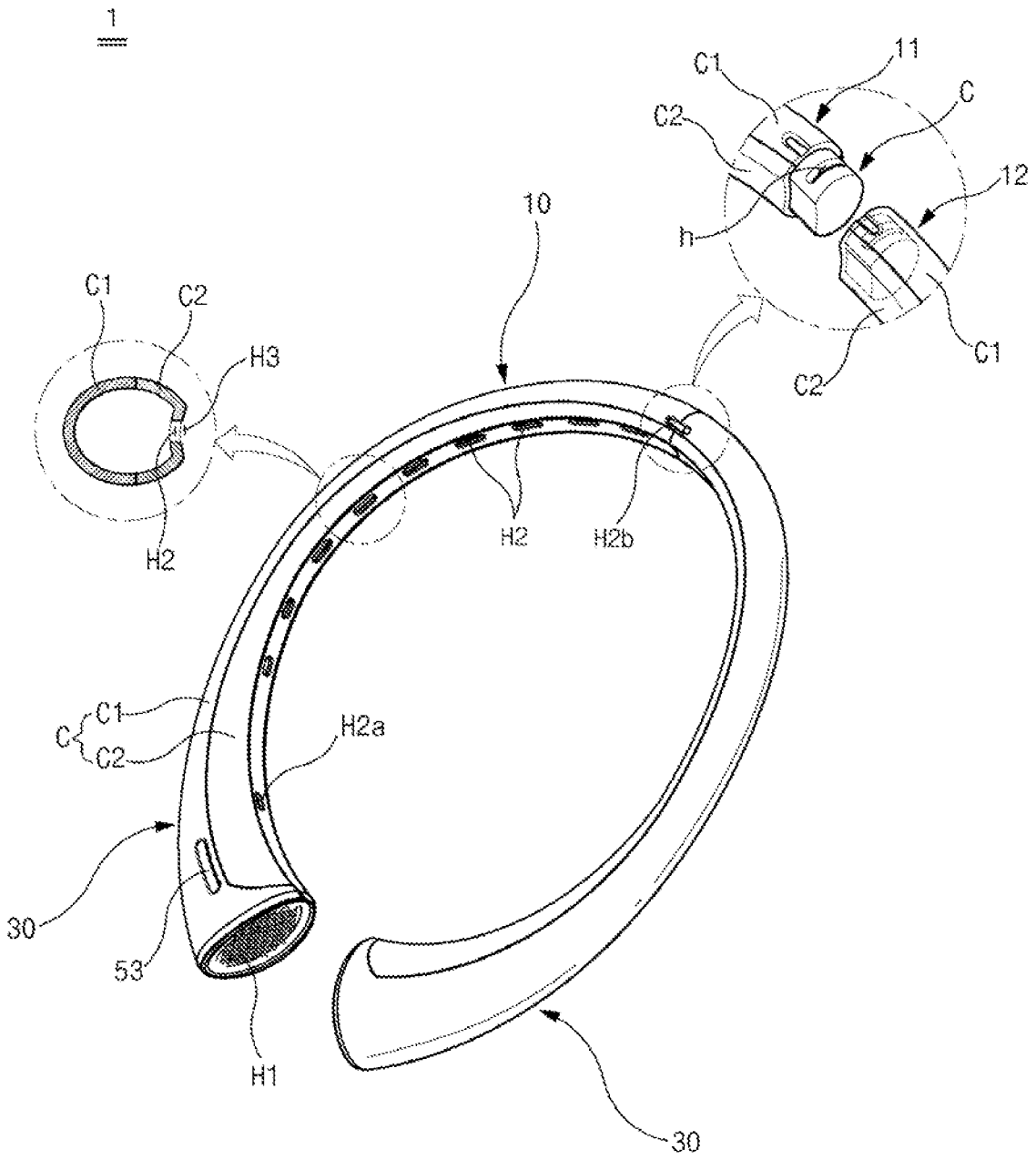

[Fig. 2]
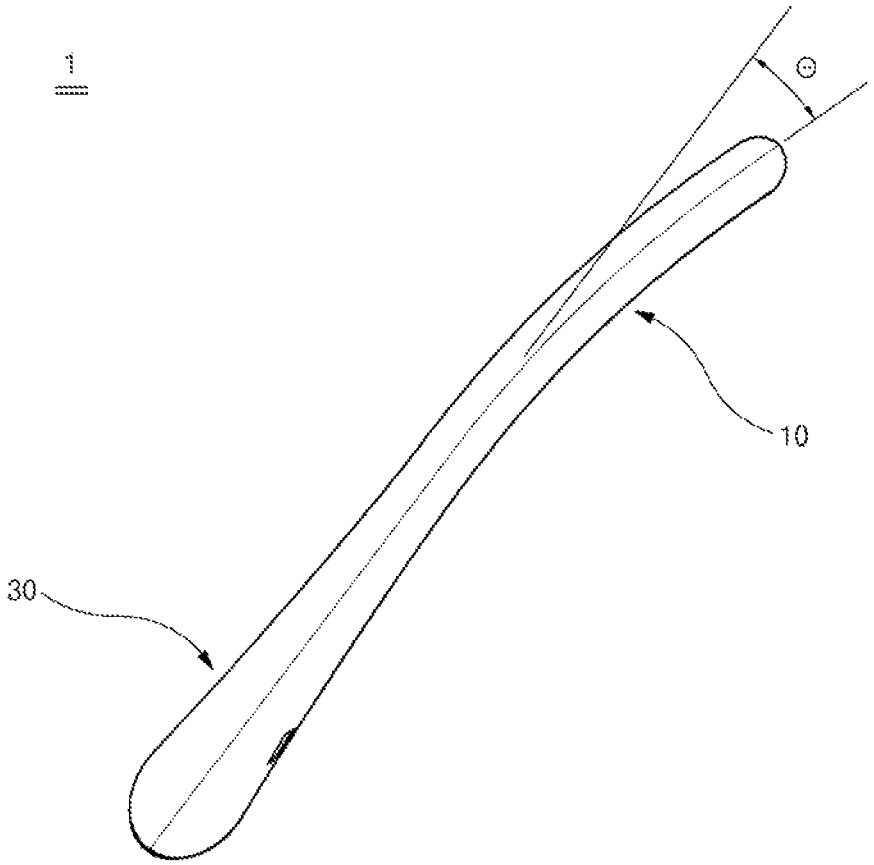

[Fig. 3]
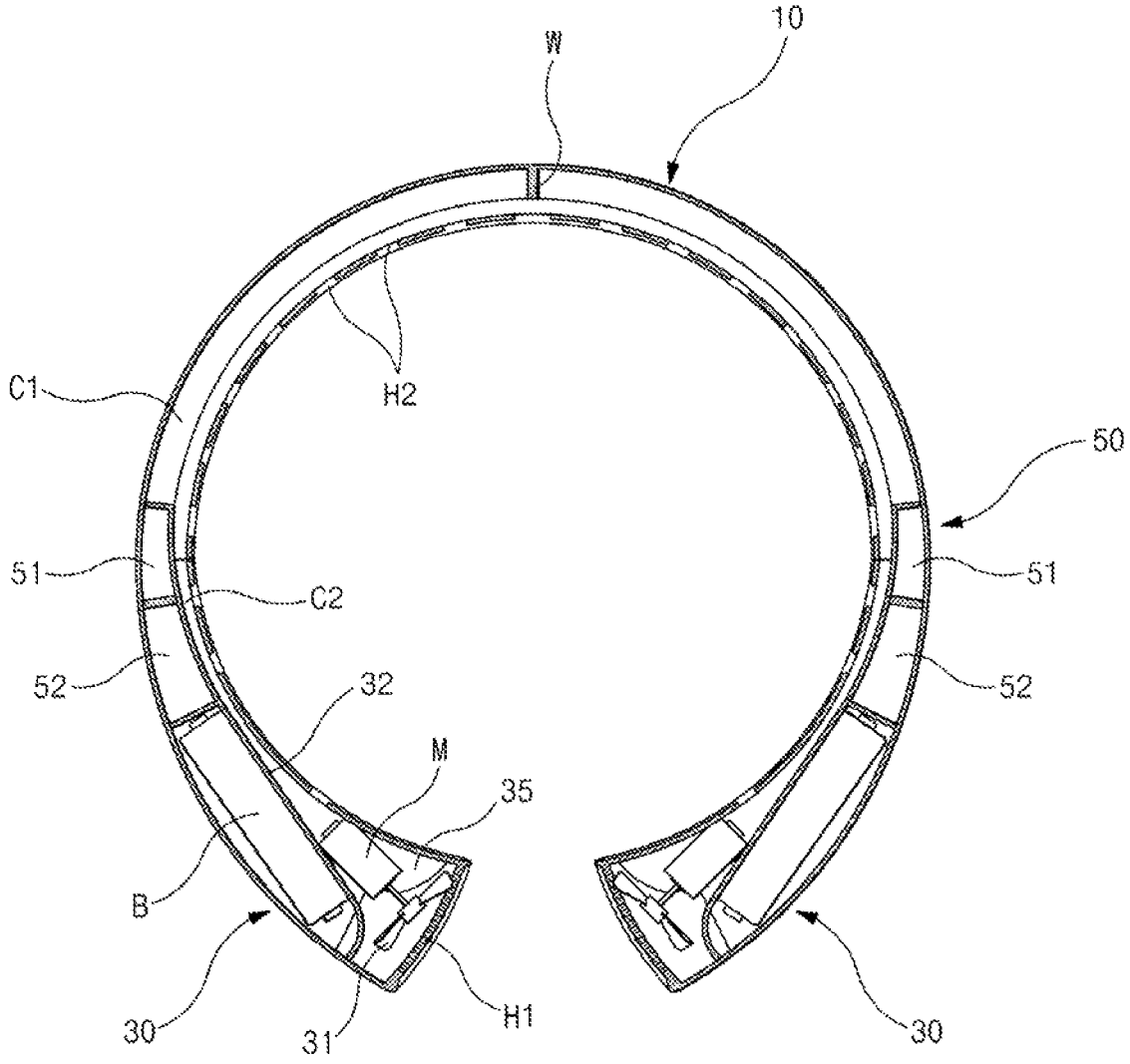

[Fig. 4]
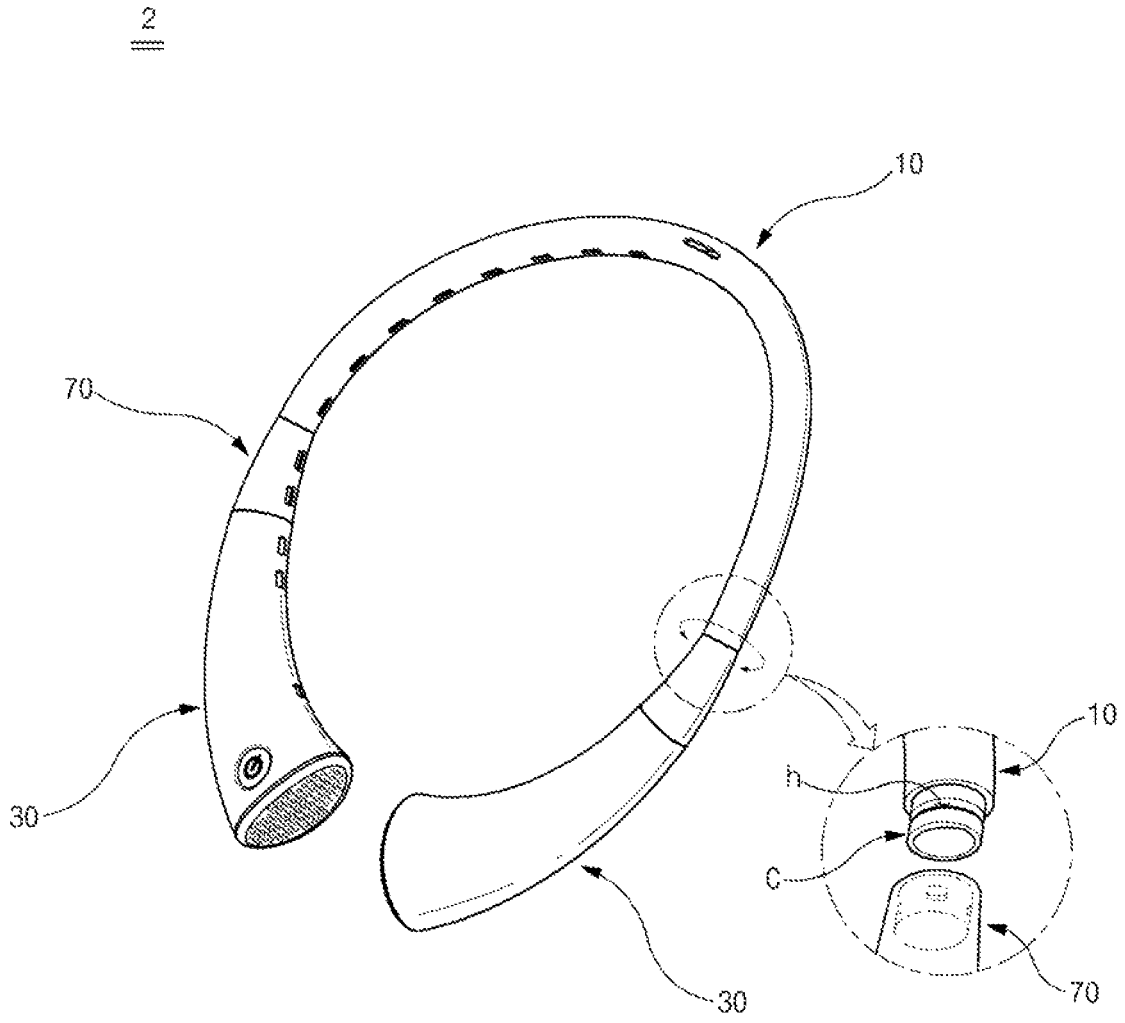

[Fig. 5]
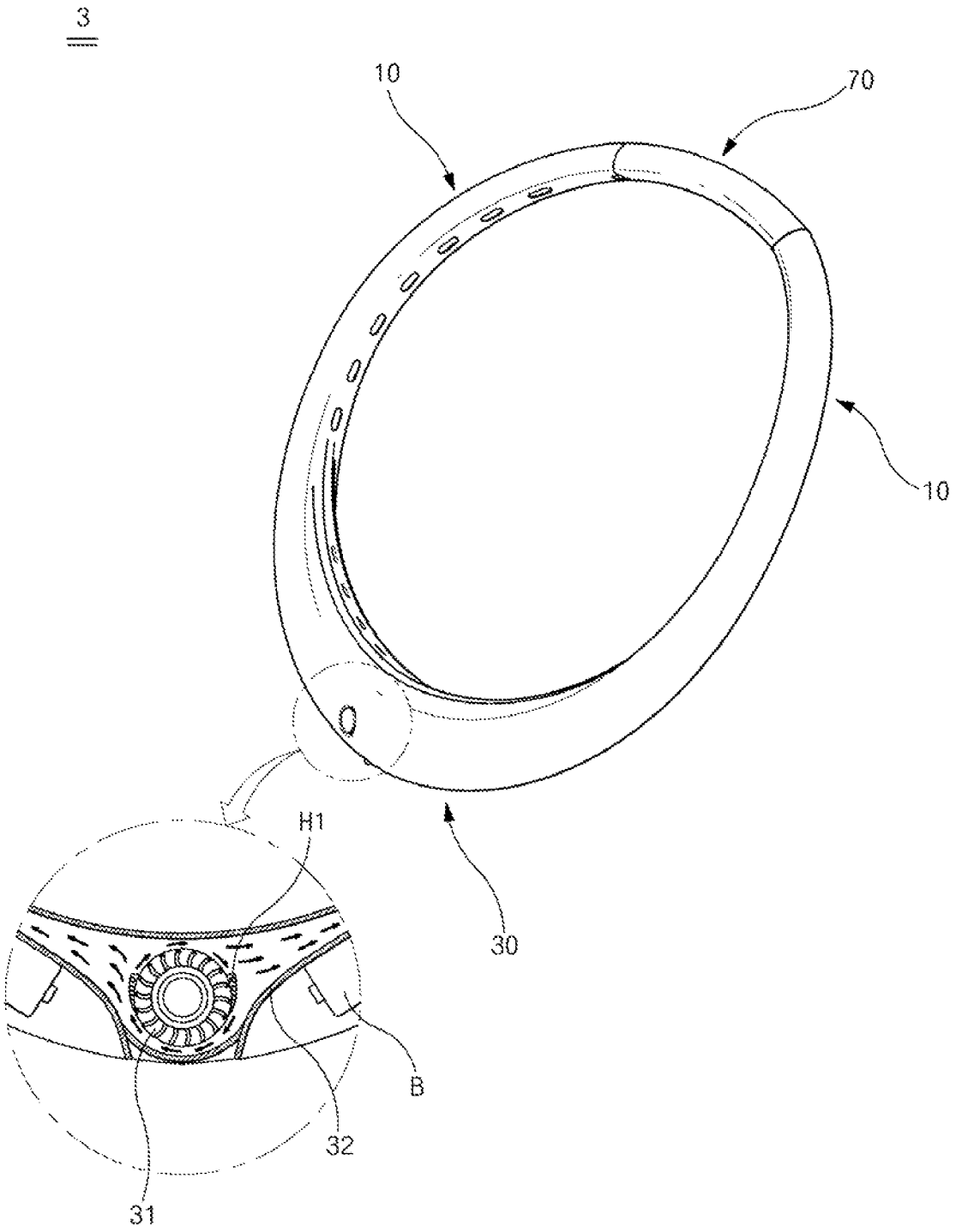

[Fig. 6]
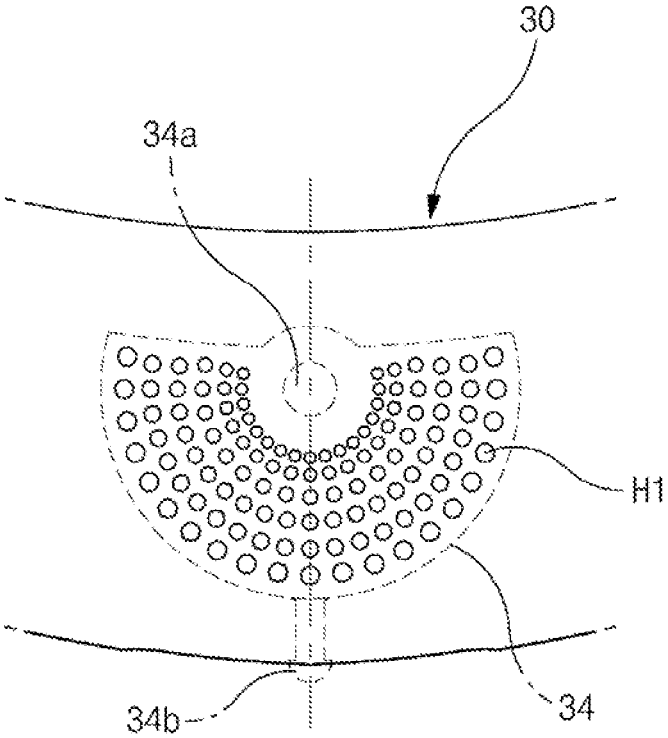
( a )
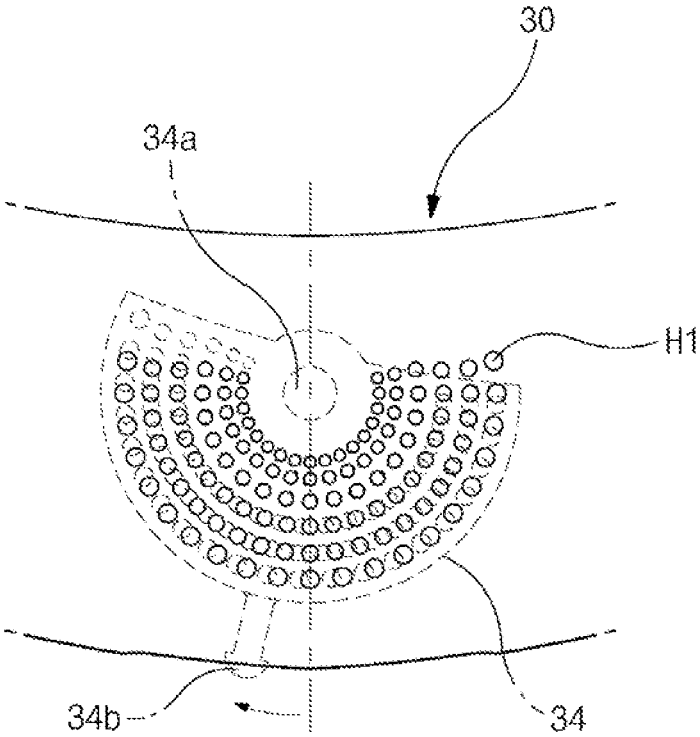
( b )

NECKLACE-TYPE FAN

CROSS REFERENCE TO PRIOR APPLICATIONS

This application is a National Stage Application of PCT International Patent Application No. PCT/KR2015/000298 filed on Jan. 12, 2015, under 35 U.S.C. § 371, which is hereby incorporated by reference in their entirety.

TECHNICAL FIELD

The present invention relates to a necklace-type fan, and more particularly, to a necklace-type fan which is formed to allow a user to hang a portable fan around the user's neck and configured to blow cool air toward the user's neck when the user wears the portable fan.

BACKGROUND ART

A fan is a mechanical device that generates the wind by rotating blades mounted on a shaft of an electric motor to allow a user to feel cool. The fan is mainly used to generate a cool wind during a hot summer, and the fan is also used to ventilate a stuffy basement or the like, dry laundry, cool hot food, or dry the user's hair after a bath. The user feels cool because an air flow generated by the fan promotes evaporation of sweat or other liquid secretion on the skin and absorbs evaporation heat.

Depending on the shape and use of the fan, the fan is classified into a tabletop fan, a stand fan, a ventilating fan, a ceiling fan, and a portable fan, and there are a remote control type fan of which the speed and the rotation can be adjusted from a remote place, and a fan in which a microcomputer with an installed program is embedded to automatically adjust the intensity of the wind to enable the user to sleep comfortably.

Among the fans, the portable fan is manufactured to have a small size to enable the user to carry the portable fan by storing the portable fan in a bag or a handbag and then use the portable fan, and the portable fan includes a small-sized motor operated by a battery, blades, and a casing, such that the user may hold a handle and supply the wind to a desired body portion.

The portable fan is manufactured to have a small size to enable the user to carry the portable fan, but in a case in which the user goes out without a bag that can accommodate the portable fan, the user inevitably holds the portable fan by hand because the portable fan is too large in size to be accommodated in a trouser pocket or a pocket of an upper garment, and as a result, the user often loses the portable fan. In addition, when the user does exercise such as a bicycle ride or jogging, acceleration and deceleration are continuously applied to the user's body and arms, and as a result, there is a problem in that the user is inconvenienced by holding the portable fan over a long period of time or accommodating the portable fan in the pocket.

To solve the aforementioned problem, there is a necklace type small-sized fan connected to a strap that enables the fan to be hung around the neck among the portable fans. In the related art, the necklace type small-sized fan coupled to the strap may be fixed close to the user's neck and face in a state in which the strap is hung around the user's neck, and as a result, it is possible to supply the wind in a state in which the necklace type small-sized fan is close to the user's face.

However, in the case of the small-sized fan in the related art, a load of the small-sized fan including the motor and the battery is applied to the neck through the thin strap, and as a result, there is a problem in that stress is applied to a rear portion of the neck or miliaria occurs when the user continuously wears the small-sized fan.

In addition, because the small-sized fan is hung from the neck at a lower end of the strap, the strap swings in the left and right direction like a pendulum in a state in which tension caused by a load of the small-sized fan is applied to the strap when the user moves, for example, walks or rides a bicycle, and as a result, there is a problem in that the user's neck has an abrasion caused by persistent friction.

Furthermore, in a state in which the small-sized fan is hung from the user's neck through the strap, the wind blows only toward the top side, and as a result, there is a drawback in that the wind just reaches a front side of the user's neck or a lower side of the user's chin, and therefore, the user is inconvenienced because the user needs to often hold and move the small-sized fan toward the rear portion of the neck and the lateral side of the face in order to evenly supply the wind to the user's neck and face.

DISCLOSURE

Technical Problem

An object of the present invention is to provide a necklace-type fan which is capable of evenly supplying the wind to a user's neck, upper body, or face in a state in which the user wears the necklace-type fan without holding and moving the necklace-type fan, capable of preventing stress on the user's neck and irritation caused by miliaria and an abrasion even if the user wears the necklace-type fan over a long period of time, and capable of automatically changing intensity of the wind.

Technical Solution

The aforementioned object is achieved by a necklace-type fan according to the present invention, including: a necklace part which has a curved tube shape, and has a plurality of wind blowing holes formed in a longitudinal direction of the necklace part; a wind generation part which has an interior being in communication with the necklace part, and has a fan installed to pump the wind into the necklace part; and a control unit which adjusts a rotational speed of the fan, in which the wind introduced through the wind generation part is discharged through the wind blowing holes while being changed in intensity by the control unit.

The wind generation part may have a wind inlet port which is penetratively formed so that outside air is introduced.

The wind generation part may have a regulator which closes or opens the wind inlet port.

A cross-sectional area of the wind generation part through which the wind passes may be decreased in a direction close to the necklace part, so that a velocity of the wind introduced into the necklace part is increased.

The necklace part may be formed to surround the neck and configured to be elastically bendable and deformable so that both end portions thereof are spread.

The necklace part or the wind generation part may have a mounting portion on which a battery is mounted, and the control unit may include: a receiving unit which receives data from an external electronic device in a wired or wireless manner; and an adjusting unit which adjusts voltage applied to the fan from the battery based on a signal of the receiving unit.

A wind flow groove may be formed in an outer surface of the necklace part in the longitudinal direction, the plurality of wind blowing holes may be formed inside the wind flow groove, and when the necklace part comes into close contact with the wearer's neck, the wind discharged from the wind blowing holes may absorb heat of the skin while flowing along the wind flow groove.

The wind generation part may have an anion generating unit.

The wind generation parts may be formed at both end portions of the necklace part, and a partition wall, which divides an internal space, may be formed in the necklace part.

The wind generation parts may be formed at both end portions of the necklace part, respectively, and the necklace part may include: a first necklace part which has an end portion at which one wind generation part is formed; and a second necklace part which is rotatably coupled to the first necklace part, and has an end portion at which the other wind generation part is formed.

The wind generation parts may be connected to both end portions of the necklace part, respectively, by connectors, and the wind generation part or the necklace part may be rotatably coupled to the connector.

The wind generation parts may be connected to both end portions of the necklace part, respectively, by connectors, and the connector may be configured to be extensible and contractible by external force so that the wind generation part is rotatable relative to the necklace part.

The necklace parts may be formed at both sides of the wind generation part, respectively, the fan may be a centrifugal fan, and the wind generation part and the necklace parts may be in communication with one another in a direction orthogonal to a rotating shaft of the fan.

The centrifugal fan may be a forward-curved blade fan which has blades curved forward.

Advantageous Effects

According to the present invention, the plurality of wind blowing holes is formed in the longitudinal direction of the necklace part, and as a result, it is possible to provide the necklace-type fan capable of evenly supplying the wind around the neck in a state in which the user wears the necklace-type fan without holding and moving the necklace-type fan.

In addition, the wind flow groove in which the wind blowing holes are disposed therein is formed in the outer surface of the necklace part in the longitudinal direction, and as a result, even though the necklace part comes into close contact with the skin, the wind blowing holes are not blocked, but the wind flows along the wind flow groove, thereby absorbing heat of the skin, and therefore, it is possible to provide the necklace-type fan capable of preventing stress on the neck and irritation caused by miliaria and an abrasion on the neck even if the user wears the necklace-type fan around the user's neck over a long period of time.

Furthermore, since the control unit for adjusting a rotational speed of the fan is installed, intensity of the wind is changed automatically or based on a signal from an external electronic device, and therefore, it is possible to provide the necklace-type fan capable of enabling the user to feel a change in cool wind without feeling stuffy due to the wind blowing with constant intensity or feeling irritation on the skin even though the user wears the necklace-type fan over a long period of time.

DESCRIPTION OF DRAWINGS

FIG. 1 is a perspective view of a necklace-type fan according to an exemplary embodiment of the present invention.

FIG. 2 is a side view of the necklace-type fan in FIG. 1.

FIG. 3 is a cross-sectional view of the necklace-type fan in FIG. 1.

FIG. 4 is a perspective view of a necklace-type fan according to another exemplary embodiment of the present invention.

FIG. 5 is a perspective view of a necklace-type fan according to still another exemplary embodiment of the present invention.

FIG. 6 is a view illustrating a wind inlet port of the necklace-type fan in FIG. 5.

BEST MODE

Hereinafter, exemplary embodiments of the present invention will be described in detail with reference to the accompanying drawings. However, in the description of the present invention, a description of a function or configuration already publicly known will be omitted in order clarify the subject matter of the present invention.

A necklace-type fan according to the present invention is configured to be capable of evenly supplying the wind to a user's neck, upper body, or face in a state in which the user wears the necklace-type fan without holding and moving the necklace-type fan, preventing stress on the user's neck and irritation caused by miliaria and an abrasion even if the user wears the necklace-type fan over a long period of time, and automatically changing intensity of the wind.

FIG. 1 is a perspective view of a necklace-type fan according to an exemplary embodiment of the present invention, FIG. 2 is a side view of the necklace-type fan in FIG. 1, FIG. 3 is a cross-sectional view of the necklace-type fan in FIG. 1, FIG. 4 is a perspective view of a necklace-type fan according to another exemplary embodiment of the present invention, FIG. 5 is a perspective view of a necklace-type fan according to still another exemplary embodiment of the present invention, and FIG. 6 is a view illustrating a wind inlet port of the necklace-type fan in FIG. 5.

As illustrated in FIGS. 1 to 3, a necklace-type fan 1 according to an exemplary embodiment of the present invention is formed to be hung around a user's neck and configured to blow cool air toward the user's neck when the user wears the necklace-type fan 1, and the necklace-type fan 1 includes a necklace part 10, wind generation parts 30, and a control unit 50.

As illustrated in FIGS. 1 and 2, the necklace part 10 is worn around the user's neck and configured to supply the wind introduced through the wind generation part 30 along a circumference of the user's neck, and the necklace part 10 is formed in a curved tube shape surrounding the user's neck. A plurality of wind blowing holes H2 is penetratively formed in a longitudinal direction of the necklace part 10.

As illustrated in FIGS. 1 and 3, the wind generation part 30 has a fan 31 installed therein, and the wind generation part 30 is configured to pump air into the necklace part 10 and formed in a tube shape such that the interior of the wind generation part 30 is in communication with the necklace part 10.

As illustrated in FIGS. 1 and 3, the wind generation parts 30 extend from both end portions of the necklace part 10, and the same radius of curvature is formed at boundaries between the necklace part 10 and the wind generation parts 30. Since the same radius of curvature is formed at the boundaries between the necklace part 10 and the wind generation parts 30, it is possible to prevent feeling of irritation that may be felt by the skin due to different radii of curvature.

To basically solve the problem of feeling of irritation, in the exemplary embodiment of the present invention, the wind generation parts 30 and the necklace part 10 are integrally connected to a casing C, as illustrated in FIGS. 1 to 3.

As illustrated in FIG. 1, the casing C includes a first casing C1 and a second casing C2. The first casing C1 and the second casing C2 are coupled to each other in the longitudinal direction to form a circular or elliptical cross section along which the wind flows in the longitudinal direction.

As illustrated in FIG. 1, the first casing C1 defines a surface which is observed from the outside when the user wears the necklace-type fan 1 in a state in which the wind generation parts 30 and the necklace part 10 surround the user's neck, and the second casing C2 defines a surface which is formed toward the radius of curvature and may come into contact with the user's neck in the state in which the wind generation parts 30 and the necklace part 10 surround the user's neck.

The plurality of wind blowing holes H2 is formed in the second casing C2 in the longitudinal direction. Non-described reference numeral H2*a* indicates the wind blowing holes formed in the second casing C2 of the wind generation part, and reference numeral H2*b* indicates the wind blowing holes in the second casing C2 outside a partition wall W. In addition, the wind blowing hole H2 may of course be formed in various portions.

As a body portion which extends to the chest from a lateral portion of the neck which is in contact with the necklace part 10 of the necklace-type fan 1, a clavicle is positioned and protrudes between the neck and the chest.

As illustrated in FIG. 2, the necklace part 10 has a curved portion curved at an angle θ. In a case in which the curved portion, which is smoothly curved, is formed at a portion of the necklace part 10 which is in contact with the clavicle, portions of the wind generation parts 30 and the necklace part 10, which are positioned below the curved portion, are in contact with the chest of the wearer when the wearer wears the necklace-type fan 1, and a portion of the necklace part 10, which is positioned above the curved portion, is comfortably in contact with the wearer's shoulder and the rear portion of the wearer's neck by the curved portion having the angle of θ.

As illustrated in FIG. 2, the curved portion may be injection-molded in a state in which the curved shape is fixed, but the curved portion may be formed to have bellows or an articulated structure so as to be freely deformed in accordance with the user's body condition.

As illustrated in FIGS. 1 and 3, the extending end portions of the wind generation parts 30 are formed to be spaced apart from each other and face each other at a predetermined inclination.

Of course, the extending end portions of the wind generation parts 30 may be formed to entirely face each other, but as illustrated in the exemplary embodiment of the present invention, the extending end portions of the wind generation parts 30 may be formed to obliquely face each other so that first, outside air is smoothly introduced into the wind generation parts 30, and second, the various oblique shapes define aesthetically attractive design.

As illustrated in FIG. 1, the casing C is made of an elastically bendable and deformable material so that both end portions of the casing C, that is, the end portions of the wind generation parts 30, which are spaced apart from each other, are moved away from each other when the user wears the necklace-type fan 1. The first casing C1 and the second casing C2 are made of soft synthetic resin which is elastically deformable.

Of course, because the second casing C2 comes into contact with the wearer's neck, the second casing C2 may be made of resiliently deformable rubber or silicone in order to reduce impact and frictional force transmitted to the neck even if the second casing C2 is in contact with the neck over a long period of time or the wearer does exercise in a state in which the wearer wears the necklace-type fan 1.

As illustrated in FIGS. 1 and 3, wind inlet ports H1, which are penetratively formed so that outside air is introduced, are formed in the end portions of the wind generation parts 30 which obliquely face each other. The wind inlet port H1 may be formed in the form of a mesh so as to prevent an inflow of outside foreign substances.

As illustrated in FIG. 3, the fan 31 and a motor M are installed in the casing C of the wind generation part 30. A rotating shaft of the motor M is disposed in parallel with an internal passageway being in communication with the necklace part 10 from the wind inlet port H1, and the fan 31 is disposed in the casing C so as to be directed toward the wind inlet port H1. When the fan 31 is rotated by the motor M, the fan 31 allows air in the wind inlet port H1 to flow toward the necklace part 10.

As illustrated in FIG. 1, an operating button 53 for applying power of a battery B to the motor M is formed on an outer surface of the casing C of the wind generation part 30, and as illustrated in FIG. 3, a mounting portion 32 on which the battery B is mounted is formed in the wind generation part 30.

As illustrated in FIGS. 1 and 3, the wind generation part 30 may be formed such that a cross-sectional area through which the wind passes is decreased in a direction close to the necklace part 10 from the wind inlet port H1. In a case in which the cross-sectional area through which the wind passes is decreased in a direction close to the necklace part 10, a velocity of the wind is increased in a direction close to the necklace part 10 from the wind inlet port H1.

Referring to FIG. 3, the wind, which is introduced from the wind generation part 30 into the necklace part 10, is discharged toward the wearer's neck through the plurality of wind blowing holes H2 formed in the longitudinal direction of the necklace part 10. The wind, which is discharged through the wind blowing holes H2, absorbs heat of the skin around the neck, and then discharged into the atmosphere.

As illustrated in FIG. 3, a partition wall W for dividing an internal space in the necklace part 10 is formed in the necklace part 10. In more detail, the partition wall W is formed in the middle of the necklace part 10, and interference between the winds flowing in the opposite directions from the wind generation parts 30 at both sides of the necklace part 10 toward the necklace part 10 is prevented by the partition wall W, thereby preventing intensity of the wind from being decreased.

As illustrated in the enlarged view in FIG. 1, a wind flow groove H3 is formed in the longitudinal direction in an outer surface of the necklace part 10, that is, in the second casing C2.

There are effects in that the plurality of wind blowing holes H2 is formed inside the wind flow groove H3, and the wind blowing holes H2 are prevented from being blocked by the skin even though the necklace part 10 comes into close contact with the wearer's neck, and when the necklace part 10 comes into close contact with the wearer's neck, the wind discharged from the wind blowing holes H2 sufficiently absorbs heat of the skin while flowing along the wind flow groove H3 and then the wind is discharged into the atmosphere.

As illustrated in FIG. 3, an anion generating unit 35 is formed in the wind generation part 30. Although not illustrated in detail, a coating layer in which muscovite, tourmaline, radium, and the like are mixed is formed on an inner surface of the casing C of the wind generation part 30.

The coating layer may be formed on an inner surface of the second casing C2 which is adjacent to the motor M. When minerals are heated by heat generated by the motor M when the necklace-type fan 1 operates, a generation rate of the anion is increased, and as a result, a large amount of anions are discharged toward the wearer's neck when the wearer wears the necklace-type fan 1 over a long period of time.

Although not illustrated, the anion generating unit 35 may be configured by a detachable anion generating unit (not illustrated) in addition to the coating layer of minerals. The anion generating unit may be installed inside or outside of the casing C of the wind generation part 30 or the necklace part 10, and the anion generating unit may be a negative corona discharge device. Because the technology related to the anion generating unit is publicly known, a detailed description thereof will be omitted.

As illustrated in FIG. 3, the control unit 50 is configured to adjust a rotational speed of the fan 31, and the control unit 50 is installed in the casing C of the wind generation part 30. The control unit 50 includes a receiving unit 51 and an adjusting unit 52. FIG. 3 illustrates a state in which the receiving unit 51 and the adjusting unit 52 are accommodated, together with the battery B in the mounting portion 32 which is divided into multiple stages.

The receiving unit 51 is configured to receive data from an external electronic device in a wired or wireless manner, and particularly, the receiving unit 51 is configured as a Bluetooth device which may perform wireless near field communication with the wearer's smartphone.

The Bluetooth device is a wireless near field communication means which is mounted in various daily commodities such as a mobile phone, an earphone, and a ballpoint pen and used to transmit data, and because the Bluetooth device is already widely publicly known, a detailed description thereof will be omitted.

The adjusting unit 52 is configured to receive a signal from the receiving unit 51 and adjust voltage applied to the fan 31 from the battery B, and the adjusting unit 52 includes a small-sized printed circuit board.

A data transmission program or application for transmitting wireless data to the receiving unit 51 through the wireless near field communication is installed in the wearer's smartphone. The data transmission program or application creates data for operating the motor M by analyzing music played by a music playing application of the smartphone for each intensity and syllable, and transmits the data to the receiving unit 51 through the wireless near field communication.

The data received by the receiving unit 51 are stored in the adjusting unit 52, or the adjusting unit 52 adjusts in real time voltage applied to the motor M from the battery B in accordance with the data.

Of course, the data transmission program or application may transmit sound data played by the music playing application of the smartphone as they are to the receiving unit 51 through the wireless near field communication without processing the sound data, and the adjusting unit 52 may change voltage applied to the motor M for each intensity and syllable of the sound of the sound data.

When the voltage applied to the motor M is adjusted at every moment based on the sound data, the rotational speed of the fan 31 is changed in accordance with the sound played by the smartphone, and as a result, the wind introduced through the wind generation part 30 is changed in intensity and then introduced into the necklace part 10.

The user of the necklace-type fan 1 may feel the change in wind around the neck which corresponds to the intensity and syllable of the sound played by the smartphone, and as a result, the user may feel a change in cool wind without feeling stuffy due to the wind blowing with constant intensity or feeling irritation on the skin even if the user wears the necklace-type fan 1 over a long period of time.

Of course, basic data for adjusting voltage applied to the motor M with intensity in a predetermined pattern and at a predetermined interval is stored in the adjusting unit 52, and as a result, it is possible to adjust intensity and intervals of the wind by operating the operating button 53 even though the receiving unit 51 does not receive the data.

As illustrated in FIG. 1, the necklace part 10 of the necklace-type fan 1 is divided into a first necklace part 11 and a second necklace part 12, and the first necklace part 11 and the second necklace part 12 may be rotatably coupled to each other.

The wind generation parts 30 are coupled to one end portion of the first necklace part 11 and one end portion of the second necklace part 12, respectively, and the other portion of the first necklace part 11 and the other portion of the second necklace part 12 are rotatably coupled to each other. As illustrated in the enlarged view in FIG. 1, the first necklace part 11 and the second necklace part 12 are coupled to each other so as to be rotatable relative to each other through a coupler C.

The coupler C has both end portions which are inserted into the internal passageways of the first necklace part 11 and the second necklace part 12, one end portion of the coupler C is inserted into the internal passageway of the first necklace part 11 and fixed so as not to be rotated, and the other end portion of the coupler C is rotatably coupled to the internal passageway of the second necklace part 12.

In more detail, a rail groove h is formed in a circumferential direction in an outer circumferential surface of the other end portion of the coupler C, and a protruding portion, which is inserted to be movable along the rail groove h, is formed on an inner circumferential surface of the second necklace part 12. Although not illustrated, catching portions (not illustrated), which are caught to prevent a relative rotation in a state in which the pair of wind inlet ports H1 faces each other when external force equal to or lower than a predetermined magnitude is applied, may be formed on the coupler C and the inner circumferential surface of the second necklace part 12.

Since the first necklace part 11 and the second necklace part 12 are coupled to each other to be rotatable relative to each other as described above, the user may hang the necklace-type fan 1 around the neck in a state in which the first necklace part 11 and the second necklace part 12 are rotated relative to each other so that the pair of wind inlet ports H1 is spaced apart from each other, and then the user may rotate the first necklace part 11 and the second necklace part 12 relative to each other so that the wind inlet ports H1 face each other again, and as a result, the user may easily wear the necklace-type fan 1 without elastically bending and deforming the necklace part 10 when wearing the necklace-type fan 1.

As illustrated in FIG. 4, in a necklace-type fan 2 according to another exemplary embodiment of the present invention, the necklace part 10 and the wind generation part 30 are rotatable relative to each other through a connector 70.

The connectors 70 are coupled to both end portions of the necklace part 10, respectively, and the pair of wind generation parts 30 is coupled to the connectors 70, respectively. Although not illustrated in detail, the connector 70 may be made of a material that may be extended and contracted by external force equal to or higher than a predetermined magnitude, that is, the connector 70 may be made of rubber or silicone or may have a bellows structure.

Since the necklace part 10 and the wind generation part 30 are connected to each other through the extensible and contractible connector 70, when the user hangs the necklace-type fan 1 around the neck in a state in which the user holds and rotates the pair of wind generation parts 30 with both hands while deforming the connectors 70 so that the pair of wind inlet ports H1 is spaced apart from each other and then the user releases the pair of wind generation parts 30, the wind inlet ports H1 face each other again by elastic restoration of the connectors 70, and as a result, the user may easily wear the necklace-type fan 2 without elastically bending and deforming the necklace part 10 when wearing the necklace-type fan 2.

As illustrated in the enlarged view in FIG. 4, the wind generation part 30 and the necklace part 10 are rotatable relative to each other through the connector 70 and the coupler C.

Both end portions of the coupler C are inserted into the internal passageways of the necklace part 10 and the connector 70. One end portion of the coupler C is inserted into the internal passageway of the necklace part 10 and fixed so as not to be rotated, and the other end portion of the coupler C is rotatably coupled to the internal passageway of the connector 70.

In more detail, the rail groove h is formed in a circumferential direction in an outer circumferential surface of the other end portion of the coupler C, and a protruding portion, which is inserted to be movable along the rail groove h, is formed on an inner circumferential surface of the connector 70.

Although not illustrated, catching portions (not illustrated), which are caught to prevent a relative rotation in a state in which the pair of wind inlet ports H1 faces each other when external force equal to or lower than a predetermined magnitude is applied, may be formed on the coupler C and the inner circumferential surface of the connector 70.

Since the necklace part 10 and the connector 70 are coupled to each other to be rotatable relative to each other as described above, the user may hang the necklace-type fan 2 around the neck in a state in which the necklace part 10 and the wind generation part 30 are rotated relative to each other so that the pair of wind inlet ports H1 are spaced apart from each other, and then the user may rotate the necklace part 10 and the wind generation part 30 relative to each other so that the wind inlet ports H1 face each other again, and as a result, the user may easily wear the necklace-type fan 2 without elastically bending and deforming the necklace part 10 when wearing the necklace-type fan 2.

As illustrated in FIG. 5, in a necklace-type fan 3 according to still another exemplary embodiment of the present invention, the necklace parts 10 are formed at both sides of the wind generation part 30, respectively, and the fan 31 may be a centrifugal fan capable of simultaneously sending the wind to both of the necklace parts 10.

When the centrifugal fan is installed in the casing C of the wind generation part 30 as illustrated in the enlarged view in FIG. 5, and the wind inlet port H1 is formed in a rear surface of the casing C as illustrated in FIG. 6A, the wind introduced into the casing C is introduced in a direction parallel to a rotating shaft of the centrifugal fan, and the wind, which flows toward the necklace part 10 in the casing C, is discharged in a direction orthogonal to the rotating shaft.

Since the rotating shaft of the centrifugal fan is installed in the casing C of the wind generation part 30 so as to be directed toward the user's front side, a thickness of the wind generation part 30 may be decreased, and the wind, which is discharged from blades of the fan 31 in a direction perpendicular to the rotating shaft, is pumped toward the necklace part 10 in a state in which a loss caused by friction is minimized by the mounting portions 32 which are formed on the left and right sides in the casing C so as to have a curved surface so as to minimize pipeline resistance.

The centrifugal fan is a forward-curved blade fan of which the blades are curved forward. In a case in which the centrifugal fan has the multiple blades which are curved in the rotation direction, it is possible to output a high air flow rate and a high wind velocity.

The wind inlet port H1 is an inlet through which the wind is introduced toward a hub of the centrifugal fan from the outside, and the wind inlet port H1 is formed at a rear side of the casing C at a position corresponding to the hub of the centrifugal fan. The wind inlet port H1 includes a plurality of holes formed in a circumferential direction of the centrifugal fan.

The operating button 53 for operating the motor M is provided on a front surface of the wind generation part 30 in order to enable the user to easily manipulate the operating button 53.

As illustrated in FIG. 6, in the necklace-type fan 3 according to still another exemplary embodiment of the present invention, a regulator 34 for closing or opening the wind inlet port H1, may be provided on the casing C of the wind generation part 30.

The regulator 34 is formed in a circular or fan shape and rotatably coupled to the casing C of the wind generation part 30 by a rotating shaft 34*a* disposed coaxially with the rotating shaft of the centrifugal fan. A plurality of holes, which is identical or corresponds to the wind inlet port H1, is penetratively formed in the regulator 34, and a lever 34*b*, which protrudes to the outside of the wind generation part 30, is formed at one side rim of the regulator 34.

As illustrated in FIG. 6A, outside air is introduced through an overall area of the wind inlet port H1 in a state in which the wind inlet port H1 coincides with the holes of the regulator 34.

As illustrated in FIG. 6B, when the wearer pushes the lever 34*b* toward one side, the regulator 34 is rotated about the rotating shaft of the centrifugal fan, and as a result, the wind inlet port H1 does not coincide with the holes of the regulator 34, such that the regulator 34 covers a part of or the entirety of the wind inlet port H1.

Since the regulator 34 for closing or opening the wind inlet port H1 is installed, it is possible to adjust the amount of wind introduced into the fan 31 through the wind inlet port H1, and as a result, it is possible to change the amount of wind to be discharged through the necklace part 10, and the user may freely adjust the amount of wind to be discharged through the necklace part 10 by manipulating the regulator 34.

As illustrated in FIG. 5, the end portions of the necklace parts 10 formed at both sides of the wind generation part 30 are connected through the connector 70.

Although not illustrated in detail, one end portion of the connector 70 is detachably coupled to the end portion of any one of the wind generation parts 30 so that the connector 70 and the end portion of the necklace part 10 are separated from each other when the user wears the necklace-type fan 3. The structure in which the connector 70 and the necklace part 10 are detachably coupled to each other may be implemented by various methods such as the magnet engagement and the engagement using a protrusion and a groove.

The connector 70 is made of rubber or silicone such that the connector 70 is softly deformed by being brought into contact with the skin when the user wears the necklace-type fan 3, and the connector 70 absorbs vibration of the fan 31, thereby serving to prevent vibration of the fan 31 from being transmitted to the user's neck.

According to the present invention, the plurality of wind blowing holes H2 is formed in the longitudinal direction of the necklace part 10, and as a result, it is possible to provide the necklace-type fan 1 capable of evenly supplying the wind around the neck in a state in which the user wears the necklace-type fan without holding and moving the necklace-type fan.

In addition, the wind flow groove H3 in which the wind blowing holes H2 are disposed therein is formed in the outer surface of the necklace part 10 in the longitudinal direction, and as a result, even though the necklace part 10 comes into close contact with the skin, the wind blowing holes H2 are not blocked, and the wind flows along the wind flow groove H3, thereby absorbing heat of the skin, and therefore, it is possible to provide the necklace-type fan 1 capable of preventing stress on the neck and irritation caused by miliaria and an abrasion on the neck even if the user wears the necklace-type fan around the user's neck over a long period of time.

Furthermore, since the control unit 50 for adjusting a rotational speed of the fan 31 is installed, intensity of the wind is changed automatically or based on a signal from an external electronic device, and therefore, it is possible to provide the necklace-type fan 1 capable of enabling the user to feel a change in cool wind without feeling stuffy due to the wind blowing with constant intensity or feeling irritation on the skin even if the user wears the necklace-type fan over a long period of time.

While the specific exemplary embodiments of the present invention have been described and illustrated, it is obvious to those skilled in the art that the present invention is not limited to the aforementioned exemplary embodiments, and may be variously changed and modified without departing from the spirit and the scope of the present invention. Therefore, the modified examples or variants should not be appreciated individually from the technical spirit or prospect of the present invention, and the modified examples belong to the claims of the present invention.

INDUSTRIAL APPLICABILITY

According to the necklace-type fan according to the present invention, since the control unit for adjusting a rotational speed of the fan is installed, intensity of the wind is changed automatically or based on a signal from an external electronic device, and as a result, it is possible to enable the user to feel a change in cool wind without feeling stuffy due to the wind blowing with constant intensity or feeling irritation on the skin even if the user wears the necklace-type fan over a long period of time, and accordingly, the present invention has industrial applicability because the present invention can surpass the limit of the existing technology, can have a sufficient commercial availability and business possibility for the applicable devices in addition to the devices used for the relevant technology, and can be carried out apparently in practice.

The invention claimed is:

1. A necklace-type fan comprising:

a necklace part which has a curved tube shape, and has a plurality of wind blowing holes formed in a longitudinal direction of the necklace part;

a wind generation part which has an interior being in communication with the necklace part, and has a fan installed to pump the wind into the necklace part; and a control unit which adjusts a rotational speed of the fan, wherein the wind introduced through the wind generation part is discharged through the wind blowing holes while being changed in intensity by the control unit, wherein the wind generation part has a wind inlet port which is penetratively formed so that outside air is introduced, and wherein the wind generation part has a regulator which closes or opens the wind inlet port.

2. The necklace-type fan of claim 1, wherein a cross-sectional area of the wind generation part through which the wind passes is decreased in a direction close to the necklace part, so that a velocity of the wind introduced into the necklace part is increased.

3. The necklace-type fan of claim 1, wherein the necklace part is formed to surround the neck and configured to be elastically bendable and deformable so that both end portions thereof are spread.

4. The necklace-type fan of claim 1, wherein the necklace part or the wind generation part has a mounting portion on which a battery is mounted, and the control unit includes:

a receiving unit which receives data from an external electronic device in a wired or wireless manner; and an adjusting unit which adjusts voltage applied to the fan from the battery based on a signal of the receiving unit.

5. A necklace-type fan comprising:

a necklace part which has a curved tube shape, and has a plurality of wind blowing holes formed in a longitudinal direction of the necklace part;

a wind generation part which has an interior being in communication with the necklace part, and has a fan installed to pump the wind into the necklace part; and a control unit which adjusts a rotational speed of the fan, wherein the wind introduced through the wind generation part is discharged through the wind blowing holes while being changed in intensity by the control unit, wherein a wind flow groove is formed in an outer surface of the necklace part in the longitudinal direction, the plurality of wind blowing holes is formed inside the wind flow groove, and when the necklace part comes into close contact with the wearer's neck, the wind discharged from the wind blowing holes absorbs heat of the skin while flowing along the wind flow groove.

6. A necklace-type fan comprising:

a necklace part which has a curved tube shape, and has a plurality of wind blowing holes formed in a longitudinal direction of the necklace part;

a wind generation part which has an interior being in communication with the necklace part, and has a fan installed to pump the wind into the necklace part; and a control unit which adjusts a rotational speed of the fan, wherein the wind introduced through the wind generation part is discharged through the wind blowing holes while being changed in intensity by the control unit, wherein the wind generation part has an anion generating unit.

7. The necklace-type fan of claim 1, wherein the necklace part has end portions, the wind generation part is formed at each of the end portions of the necklace part, and a partition wall, which divides an internal space, is formed in the necklace part.

8. The necklace-type fan of claim 1, wherein the necklace part includes:

a first necklace part which has an end portion; and a second necklace part which is rotatably coupled to the first necklace part, and has an end portion, and the wind generation part is formed at the end portion of the first necklace part and the end portion of the second necklace part, respectively.

9. The necklace-type fan of claim 1, wherein the necklace part has end portions, the wind generation part is connected to each of the end portions of the necklace part by a connector, and the wind generation part or the necklace part is rotatably coupled to the connector.

10. The necklace-type fan of claim 1, wherein the necklace part has end portions, the wind generation part is connected to each of the end portions of the necklace part by a connector, and the connector is configured to be extensible and contractible by external force so that the wind generation part is rotatable relative to the necklace part.

11. The necklace-type fan of claim 1, wherein the wind generation part has sides, the necklace part is formed at each of the sides of the wind generation part, the fan is a centrifugal fan, and the wind generation part and the necklace part are in communication with one another in a direction orthogonal to a rotating shaft of the fan.

12. The necklace-type fan of claim 11, wherein the centrifugal fan is a forward-curved blade fan which has blades curved forward.

* * * * *